US005946882A

United States Patent [19]

Focke et al.

[11] Patent Number: 5,946,882

[45] Date of Patent: Sep. 7, 1999

[54] METHOD AND DEVICE FOR MANUFACTURING PACKETS

[75] Inventors: Heinz Focke; Jürgen Focke, both of Verden, Germany

[73] Assignee: Focke & Co. (GmbH & Co.), Verden, Germany

[21] Appl. No.: 08/893,038

[22] Filed: Jul. 15, 1997

[30] Foreign Application Priority Data

Jul. 29, 1996 [DE] Germany ..... 196 30 376

[51] Int. Cl.[6] ..... B65B 55/24

[52] U.S. Cl. ..... 53/141; 53/462; 493/83; 493/373

[58] Field of Search ..... 53/462, 141; 493/911, 493/910, 83, 82, 373, 342

[56] References Cited

U.S. PATENT DOCUMENTS

| | | | |
|---|---|---|---|
| 4,171,081 | 10/1979 | Vossen et al. | 493/373 X |
| 4,537,589 | 8/1985 | Schmidt | 493/373 |
| 4,704,930 | 11/1987 | Bodewein | 83/24 |
| 4,969,639 | 11/1990 | Adair | 493/373 X |

FOREIGN PATENT DOCUMENTS

| | | | |
|---|---|---|---|
| 1213720 | 3/1966 | Germany | 493/373 |
| 29512151 | 11/1995 | Germany . | |
| 2168954 | 7/1986 | United Kingdom . | |

*Primary Examiner*—James F. Coan

*Attorney, Agent, or Firm*—Sughrue, Mion, Zinn, Macpeak & Seas, PLLC

[57] ABSTRACT

With the method according to the invention for manufacturing cigarette packets of the hinge-lid type, piles of blanks 10 are mechanically and/or pneumatically handled in a packaging machine before being processed. A cleaning station 26 has for this purpose brush systems 27, 28 acting on the piles of blanks 10 and detaching the impurities from the piles of blanks. In addition, the cleaning station 26 has extraction devices 35, 36 for pneumatically handling the piles of blanks 10. With the aid of the extraction device, the impurities detached by the mechanical cleaning members are sucked away.

5 Claims, 5 Drawing Sheets

METHOD AND DEVICE FOR MANUFACTURING PACKETS

Figure 1:
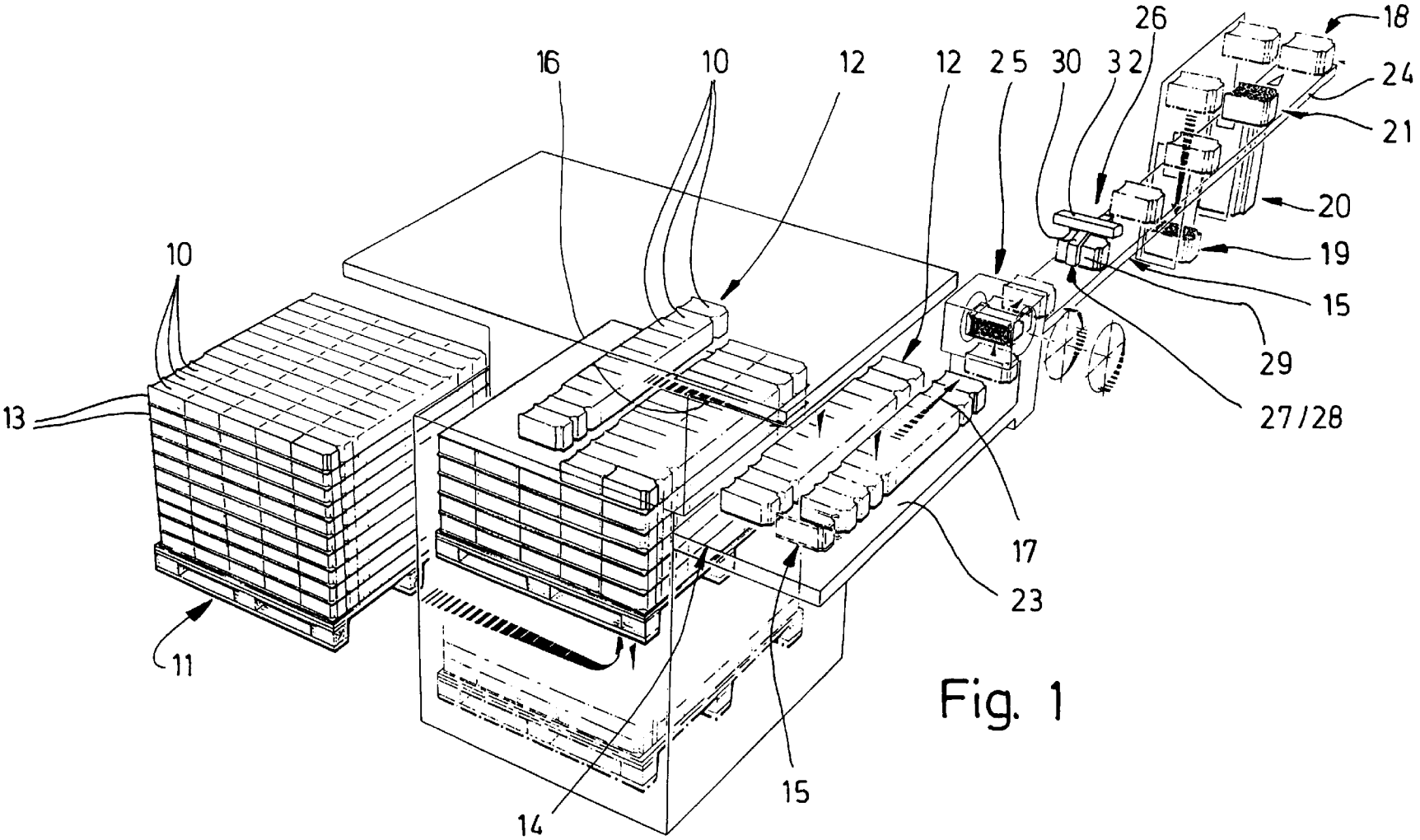

The invention relates to a method of and apparatus for manufacturing packets, especially cigarette packets of the hinge-lid type.

Blanks for hinge-lid packets are generally delivered prefabricated as piles of blanks. The piles of blanks are here generally positioned on pallets in rows arranged the one beside the other and in layers arranged the one above the other. When the pallets are emptied, rows of piles of blanks are generally lifted up from the pallet and set down on a piles conveyor. The piles of blanks are then led by this conveyor into the packing machine or a blanks magazine of the packaging machine. In the packaging machine the blanks are processed into hinge-lid packets.

The piles of blanks positioned on the pallet generally have side surfaces contaminated by paper or cardboard residue, dust or the like. If the piles of blanks are led together with these impurities into the packaging machine or its blanks magazine, this leads to impurities inside the packaging machine and thus to complications in the course of manufacture. The packaging machines therefore have to be frequently cleaned.

Proceeding from this, the problem underlying the invention is to make available a method and a device for handling piles of blanks which guarantee smooth operation of a packaging machine and a complication-free course of manufacture.

To solve this problem, the method according to the invention is characterised by the features of patent claim 1. Due to the fact that the piles of blanks are handled pneumatically and/or mechanically before being processed in the packaging machine, impurities can be removed from the piles of blanks. The piles of blanks are then led into the packaging machine, especially its blanks magazine, having been cleaned. Impurities of the latter and thus interruptions to the course of manufacture caused by the piles of blanks are avoided.

By preference, the piles of blanks are handled by at least one brush system. With the aid of the brush system, particularly simple and effective cleaning of the piles of blanks is possible.

According to an advantageous development of the invention, the piles of blanks are, in addition, pneumatically handled by at least one extraction device. This has the advantage that the impurities on the piles of blanks, mechanically removed with the aid of the or each brush system, can be sucked away immediately after they have been removed. This guarantees that the impurities removed from the piles of blanks do not lead to contamination of other regions of the packaging machine.

The device according to the invention for manufacturing packets is characterised by the features of patent claim 5. The cleaning station for mechanically and/or pneumatically cleaning the piles of blanks guarantees an uninterrupted course of manufacture and thus operation of the packaging machine.

Figure 2:
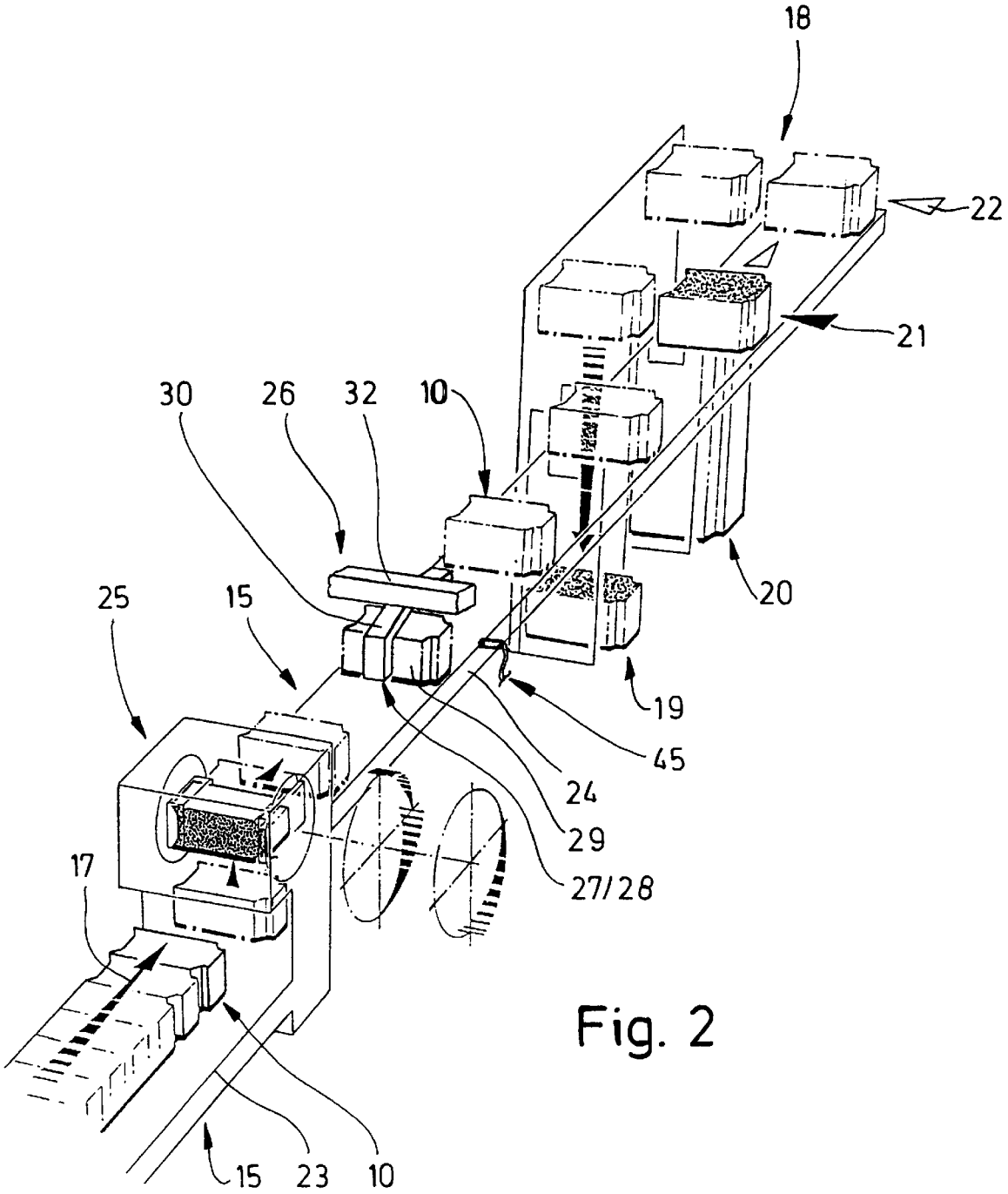
Figure 3:
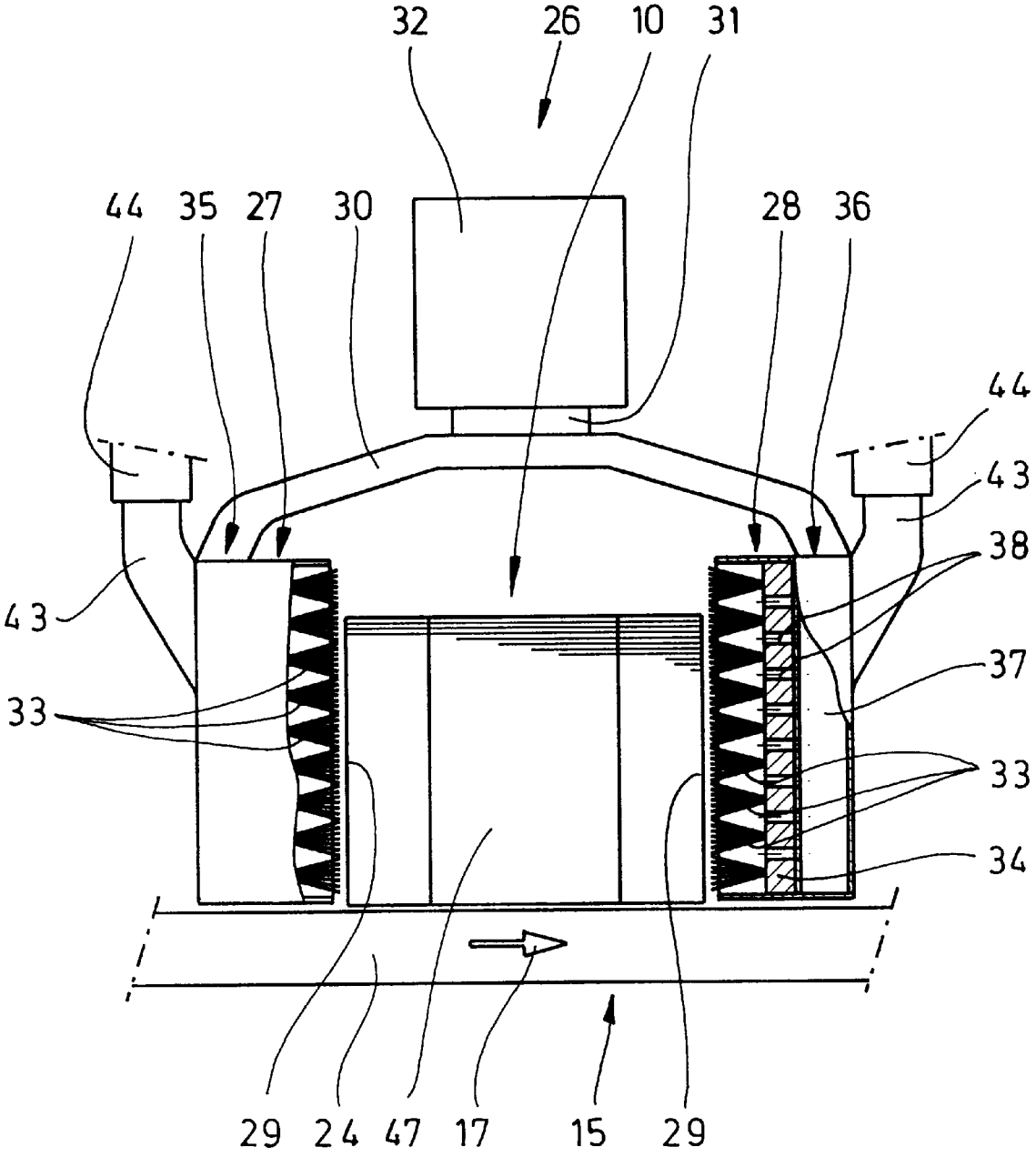
Figure 4:
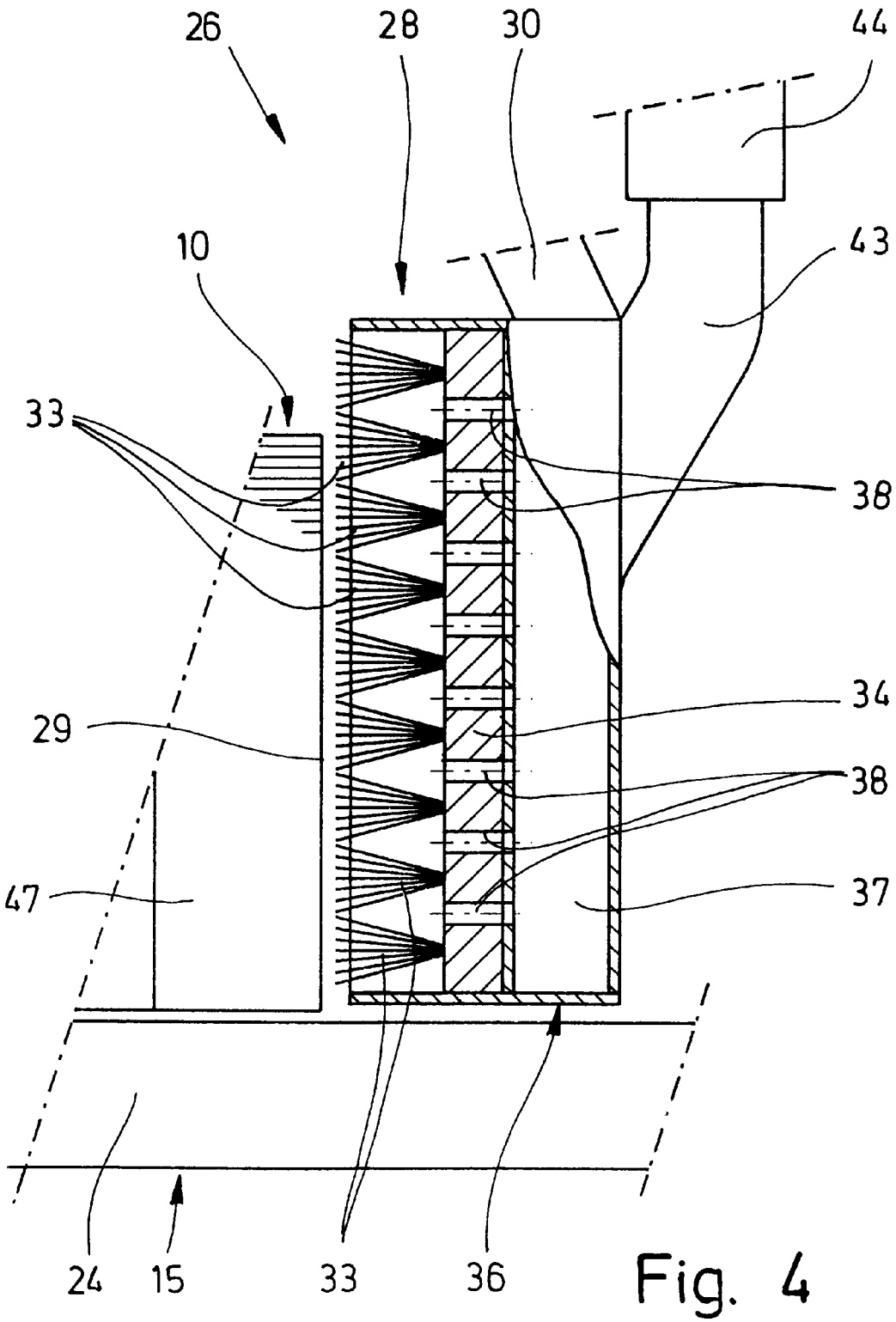
Figure 5:
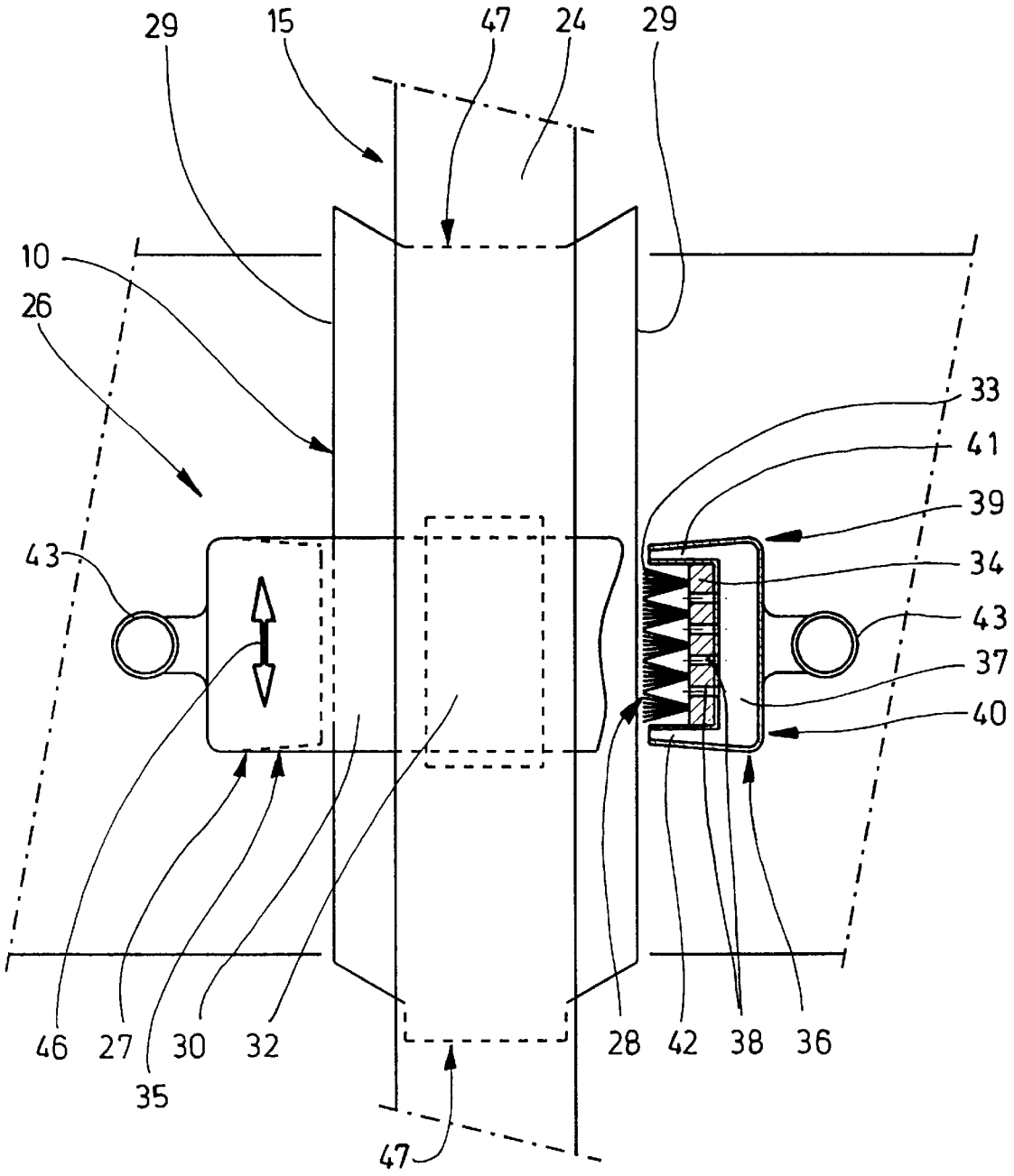

Preferred developments of the invention arise from the secondary claims and the specification. An embodiment of the invention, given by way of example, is described in greater detail below with the aid of the drawing. The figures in the drawing show:

FIG. 1 a device for manufacturing cigarette hinge-lid packets in perspective plan view, FIG. 2 an enlarged detail of the device according to FIG. 1, likewise in perspective plan view, FIG. 3 a cleaning station of the device according to FIGS. 1 and 2 in side view and partial cross-section, FIG. 4 a detail of the cleaning station according to FIG. 3, likewise in side view and in partial cross-section, and FIG. 5 the cleaning station according to FIGS. 3 and 4 in plan view.

The embodiment shown in the drawing relates to a device for manufacturing cigarette packets of the hinge-lid type.

Blanks for making the hinge-lid packets are fabricated outside the region of the packaging machine and delivered as piles of blanks 10. In the present embodiment the piles of blanks 10 are located on a pallet 11. The piles of blanks 10 are arranged forming adjacent rows 12 and layers 13 arranged the one above the other on the pallet 11.

The piles of blanks 10 are lifted row by row, i.e. in the form of rows of piles 12, from the pallet 11 by a lifting member (not shown). In this process, a complete row of piles 12 is in each case picked up as a unit by the lifting member and placed on a forward conveyor 14. Alternatively, it is also possible just to pick up portions of a row of piles 12 or individual piles of blanks 10 and pass them on to the next processing operation.

The forward conveyor 14 passes the row of piles 12 as a unit to a piles conveyor 15. The piles conveyor 15 immediately follows the forward conveyor 14. The row of piles 12 is passed from the forward conveyor 14 to the piles conveyor 15 in the direction of arrow 16.

The piles of blanks 10 are led by the piles conveyor 15 in the direction of an arrow 17 into a packaging machine. At one end 18 of the piles conveyor 15, the piles of blanks 10 are led into blanks magazines 19, 20 of the packaging machine. The movement of inserting the piles of blanks 10 into the blanks magazines 19, 20 of the packaging machine is indicated by arrows 21, 22.

The lifting member, not shown, of the device for lifting the piles of blanks 10 from the pallet 11 can be configured, for example, as in the device according to U.S. Pat. No. 4,993,915 or as in the device according to DE-OS 42 37 937. Reference is also made to the above publications in respect of the design of the forward conveyor 14 and in respect of the arrangement of the piles of blanks 10 on the pallet 11.

The piles conveyor 15 has two conveying sections 23, 24. The first conveying section 23 is allocated to the forward conveyor 14, the second conveying section 24 to the packaging machine or the blanks magazines 19, 20. The forward conveyor 14 transports the rows of piles 12 laid on same to the first conveying section 23 of the piles conveyor 15. The individual piles of blanks 10 are now led by the first conveying section 23 in the direction of arrow 17 to a turning station 25, which passes the piles of blanks 10 from the first conveying section 23 of the piles conveyor 15 to the second conveying section 24 of same.

As the piles of blanks 10 are transferred from the first conveying section 23 to the second conveying section 24 of the piles conveyor 15, the piles of blanks 10 are oriented by the turning station 25 in such a way that printed side surfaces of the blanks face upwards. For this purpose, the piles of blanks 10 are scanned opto-electrically by sensors, not shown. In addition, the piles of blanks 10 are separated into single piles by the turning station 25. The consequence of this is that the piles of blanks 10 are transported on the second conveying section 24 of the piles conveyor 15 at a distance the one from the other. The preferred distance between the individual piles of blanks 10 on the second conveying section 24 of the piles conveyor 15 is approximately 40 cm.

The piles conveyor 15, namely the first conveying section 23, plus the second conveying section 24 of same, is preferably configured as a belt conveyor. The belt conveyor has a belt, the width of which corresponds approximately to the length of the blanks or the piles of blanks 10. Constructional details can be taken from U.S. Pat. No. 4,993,915 or DE-OS 42 37 937.

A cleaning station 26 is arranged in the region of the second conveying section 24 of the piles conveyor 15. With the aid of the cleaning station 26, impurities such as, for example, paper residue, cardboard residue, clippings or dust are removed from side surfaces of the piles of blanks 10. The side surfaces of the piles of blanks correspond to upright cut edges of same which arise in the manufacture of the blanks, namely when they are cut out of so-called "panels". With the aid of the cleaning station 26, the piles of blanks 10 may be mechanically and pneumatically handled to this end.

For mechanically handling the piles of blanks 10, the cleaning station 26 has two cleaning members, namely brush systems 27, 28. The brush systems 27, 28 become effective in the region of the side surfaces, namely side walls 29, of the piles of blanks 10, the side walls 29 being oriented transversely to the direction of conveying (arrow 17) of the piles conveyor 15 or of the second conveying section 24.

The brush systems 27, 28 are connected to one another by a strap 30. The strap 30 is mounted on an actuating mechanism 32 via a coupling piece 31. With the aid of the actuating mechanism 32, the brush systems 27, 28 may be shifted transversely to the conveying direction of the piles conveyor 15. This guarantees that the brush systems 27, 28 can become effective in all the regions of the side wall 29 of the piles of blanks 10. As well as being shiftable transversely, the brush systems 27, 28 can also be moved up and down. To this end, the whole cleaning station 26 is configured capable of being moved up and down. In their resting position, the brush systems 27, 28 are located at the side, beside the piles conveyor 15. In this case, the piles of blanks 10 may be moved by the piles conveyor 15 past the brush systems 27, 28.

Each brush system 27, 28 has a plurality of individual brushes 33 arranged above and beside one another. The individual brushes 33 are at a distance from one another and fastened to a common carrying wall 34. The number of the individual brushes 33 arranged above one another is adapted to the height of the pile of blanks 10 in such a way that the side walls 29 of the pile of blanks 10 are mechanically handled over their complete height by the individual brushes 33 or the respective brush system 27, 28. According to FIGS. 3, 4, the height of the brush systems 27, 28 is greater than the height of the side walls 29 of the piles of blanks 10.

In addition to the brush systems 27, 28 for mechanically handling the piles of blanks 10, the cleaning station 26 has at least one extraction device. In the embodiment shown here, one extraction device 35, 36 is allocated to each brush system 27, 28. The extraction devices 35, 36 serve to handle the piles of blanks 10 pneumatically. They suck away the impurities removed from the side surfaces, namely the side walls 29, of the piles of blanks 10. This guarantees that the impurities removed from the side surfaces 29 do not reach the region of the piles conveyor 15 or its second conveying section 24. Rather, the detached impurities are removed by the extraction devices 35, 36 from the conveying path for the piles of blanks 10 formed by the piles conveyor 15.

The extraction devices 35, 36 each have a suction chamber 37. The suction chambers 37 of the extraction devices 35, 36 are arranged directly behind the brush systems 27, 28 or their carrying walls 34. Suction bore holes 38 open out from the suction chamber 37 into the carrying wall 34. The suction bore holes 38 are here allocated to the carrying wall 34 in such a way than one suction bore hole 38 is arranged between adjacent individual brushes 33. This is true both of the individual brushes 33 arranged beside one another and the individual brushes 33 arranged above one another of the brush systems 27, 28.

At lateral ends 39, 40 of the brush system 27, 28, the suction chamber 37 is continued, forming one suction nozzle each 41, 42. The suction nozzles 41, 42 accordingly delimit the brush systems 27, 28 or the cleaning station 26 at the side. The suction nozzles 41, 42 are formed as upright slot nozzles. They suck away the impurities occurring in the region of the side individual brushes 33 and detached from the piles of blanks 10 and thus prevent the impurities detached there from reaching the region of the piles conveyor 15.

The suction chamber 37 of the extraction device 35, 36 is connected via a pipe 43 with an extractor 44. With the aid of the extractor 44, the necessary flow of air to suck away the impurities is created.

The mechanical and pneumatic cleaning of the side walls 29 of the piles of blanks by the cleaning station 26 may be controlled by a sensor 45. The sensor 45 is arranged in the region of the piles conveyor 15 or its second conveying section 24. As a pile of blanks 10 moves past the sensor 45, the second conveying section 24 of the piles conveyor 15 is halted. The second conveying section 24 is then moved in phases. Then the cleaning station 26 is moved from above towards the pile of blanks 10. The cleaning members of brush systems 27, 28 and the extraction devices 35, 36 of the cleaning station 26 are then effective on the side walls 29 of the pile of blanks 10 and remove the impurities from same. During the mechanical and pneumatic cleaning of the piles of blanks 10, the latter according stand still. The brush systems 27, 28 or extraction devices 35, 36, are moved transversely to the conveying direction of the piles conveyor 15. This movement of the cleaning station 26 is indicated by arrow 45.

In addition to the cleaning members, which become effective in the region of the side walls 29 of the piles of blanks 10, the cleaning station 26 can have cleaning members for cleaning front faces 47 of the piles of blanks 10. These cleaning members, not shown, are expediently arranged at the side beside the piles conveyor 15. These cleaning members can also be mechanically acting brush systems and pneumatically acting extraction devices. The latter are preferably designed as fixed and clean the front faces 47 of the piles of blanks 10 as said piles are being transported on the piles conveyor 15. For cleaning the front faces 47, it is therefore not necessary for the piles conveyor 15 or its second conveying section 24 to be halted.

Differently from in the embodiment shown here, it is possible to allocate the cleaning station to the blanks magazines of the packaging machine. Where the cleaning stations are arranged in the blanks magazines, the blanks are accordingly cleaned inside the packaging machine. The cleaning is then independent of the respective piles of blanks.

We claim:

1. A device for cleaning piles of blanks, each pile of blanks having two longitudinal sides, the device comprising:

a) a piles conveyor for transporting piles of blanks in a conveying direction, such that the two longitudinal sides of the piles of blanks are transversely oriented with respect to the conveying direction; and b) a cleaning station with two opposing brush systems, said cleaning station being movable back and forth between (1) a retracted position and (2) a cleaning position in which the two brush systems are respectively arranged at the two longitudinal sides of the pile of blanks to be cleaned;

wherein the two brush systems are moveable back and forth along the longitudinal sides of the pile of blanks to be cleaned in a direction which is parallel to longitudinal edges of the blanks.

2. A device according to claim 1, wherein the brush systems comprise:

a carrying wall;

a plurality of individual brushes mounted a distance apart from one another on the carrying wall;

suction bore holes formed in the carrying wall between the individual brushes;

a suction chamber provided on a side of the carrying wall opposite the individual brushes; and an extractor connected to the suction chamber.

3. A device according to claim 2, wherein the brush systems further comprise suction nozzles provided on both sides of the individual brushes, the suction nozzles being configured as slot nozzles and connected to the suction chamber.

4. A method for cleaning piles of blanks with the aid of a brush system, said method comprising the step of:

moving the brush system back and forth along a longitudinal side of a pile of blanks to be cleaned, such that the brush system moves in a direction which is parallel to longitudinal edges of the blanks.

5. A method according to claim 4, further comprising the steps of:

a) positioning the piles of blanks in a spaced apart fashion on a piles conveyor and conveying the piles of blanks in a conveying direction;

b) orienting the piles of blanks such that each of the piles of blanks has two longitudinal sides which are transverse to the conveying direction;

c) stopping the conveyance of the pile of blanks to be cleaned in a region of a cleaning station;

d) moving the cleaning station, which includes two brush systems, from a retracted position to a cleaning position, such that the two brush systems are respectively located at the two longitudinal sides of the pile of blanks to be cleaned;

e) moving the brush systems back and forth in a direction which is transverse to the conveying direction of the piles of blanks to clean the longitudinal sides;

f) moving the cleaning station from the cleaning position to the retracted position; and g) resuming conveyance of the cleaned pile of blanks.

* * * * *